United States Patent [19]

Benson

[11] Patent Number: 4,850,797

[45] Date of Patent: Jul. 25, 1989

[54] DOUBLE CHAMBERED TURBINE HOUSING AND SEAL

[76] Inventor: Steven R. Benson, 5919 S. 350 W., Murray, Utah 84107

[21] Appl. No.: 146,582

[22] Filed: Jan. 21, 1988

[51] Int. Cl.[4] ..... F02B 37/00

[52] U.S. Cl. ..... 415/205; 285/261; 417/407

[58] Field of Search ..... 415/204, 205, 219 C, 415/203; 60/597, 605.1; 417/407; 285/261

[56] References Cited

U.S. PATENT DOCUMENTS

| | | | |
|---|---|---|---|
| 2,206,414 | 7/1940 | Markey | 285/261 |
| 2,774,618 | 12/1956 | Alderson | 285/261 X |
| 3,218,029 | 11/1965 | Woollenweber, Jr. | 415/205 |
| 4,294,073 | 10/1981 | Neff | 415/205 X |
| 4,503,680 | 3/1985 | Wood | 60/605.1 |
| 4,512,716 | 4/1985 | Marr et al. | 415/205 |

FOREIGN PATENT DOCUMENTS

| | | | |
|---|---|---|---|
| 3235538 | 3/1984 | Fed. Rep. of Germany | 417/407 |
| 3603498 | 8/1987 | Fed. Rep. of Germany | 60/597 |

*Primary Examiner*—Robert E. Garrett
*Assistant Examiner*—Joseph M. Pitko
*Attorney, Agent, or Firm*—M. Reid Russell

[57] ABSTRACT

The invention is in a double chambered turbine housing and seal that includes separate exhaust gas inlet and exhaust chambers and a turbine chamber (11) and (12) combined in a single housing (10), and provides a ball segment (29) that is secured to an exhaust inlet line (28) for telescoping within an open collar end (13) of the inlet chamber, the exhaust inlet line interior wall and collar inner surface to align so as to minimize a production of turbulence in an exhaust gas flow therethrough, which inlet chamber (11) from the collar (13) maintains a constant cross-section through a dogleg bend to a throat (14) of a scroll volute (15), the inlet chamber walls angled uniformly through the dogleg bend to minimize a creation of turbulence in that flow. The inlet chamber is formed from the scroll volute throat to have a uniform cross-sectional reduction, so as to reduce an exhaust gas flow volume traveling therein, and proportionally increase the pressure of that flow without a creation of turbulence, the volute ending in a throat (16) of a turbine chamber throat (17). The turbine chamber (17) is to contain a turbine wheel (18) journaled to turn therein of an exhaust gas turbine air compressor (191) that provides a compressing fresh air flow for combining with fuel and burning in an internal combustion engine.

16 Claims, 2 Drawing Sheets

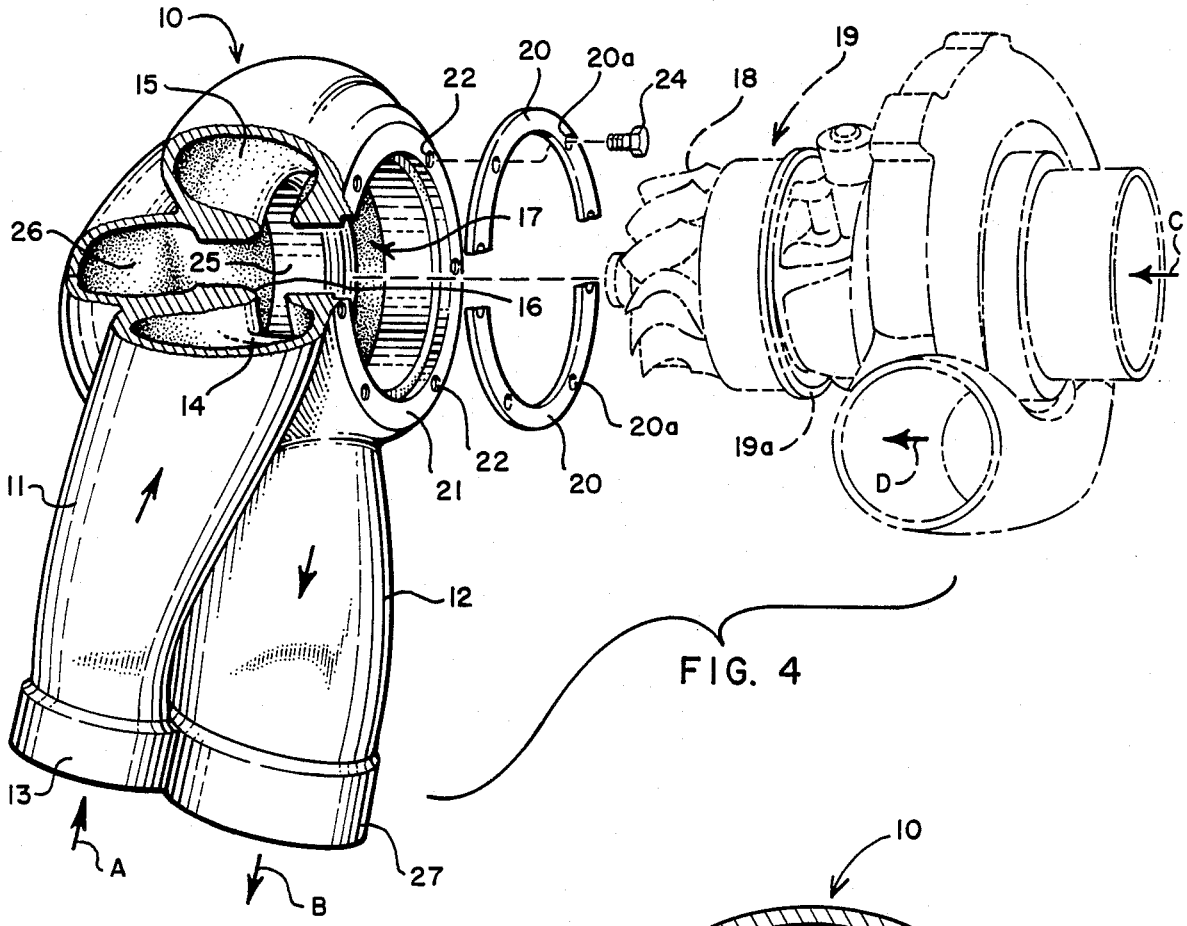
FIG. 4
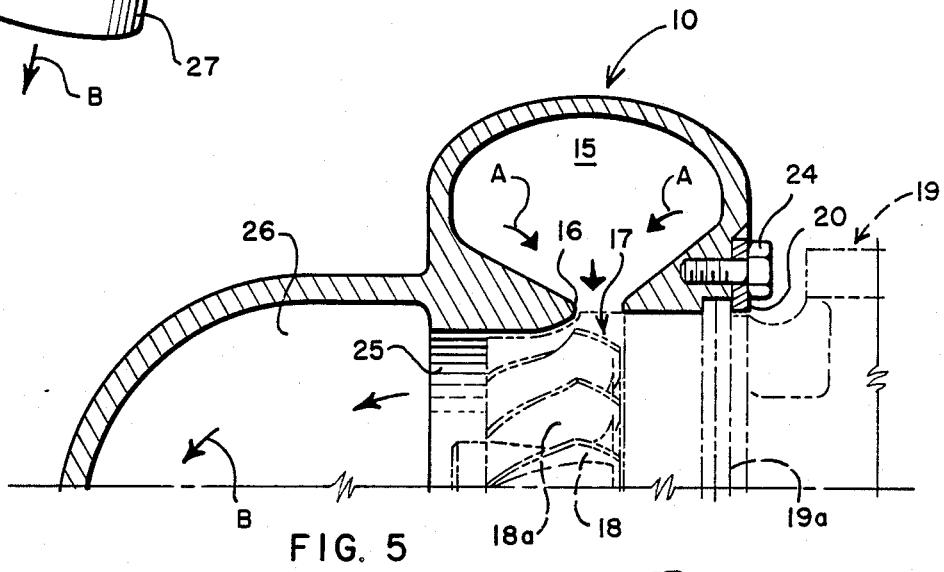
FIG. 5
FIG. 6
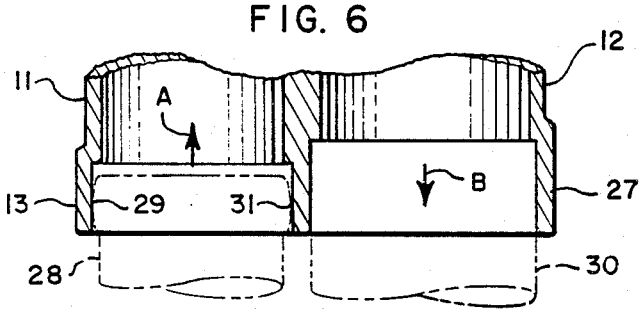
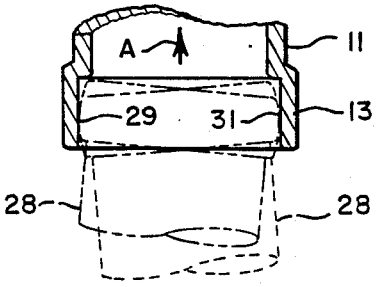
FIG. 7

DOUBLE CHAMBERED TURBINE HOUSING AND SEAL

BACKGROUND OF THE INVENTION

1. Field of the Invention

The invention relates to exhaust manifold systems and more particularly to a dual chambered turbine housing constructed to provide gas flow direction and volume changes while minimizing turbulence in that gas flow to maximize the energy available in that gas flow to turn a turbine wheel of an exhaust gas driven turbine air compressor.

2. Prior Art

The present invention constitutes an improvement in manifold systems for passing exhaust gas from an internal combustion engine to drive or turn a turbine wheel of an exhaust gas driven air compressor, that provides an inlet flow of air under pressure to an intake manifold of a gasoline or diesel engine turbo system. Heretofore, arrangements for transferring exhaust gases to an inlet side of a turbine housing volute have generally involved pipes that are bent to fit within the space or area available in an engine compartment and have accordingly ignored losses as are incurred through a creation of turbulence at sharp bends and flange type couplings of pipes transferring exhaust gas.

Further, most earlier systems have utilized separate inlet exhaust lines leading from, respectively, the engine exhaust manifold to the turbine inlet and from that turbine to the vehicle exhaust system. Unlike such separate line systems, an earlier patent by the present inventor entitled "Double Chambered Exhaust Manifold", U.S. Pat. No. 4,514,986, issued May 7, 1985 shows both inlet and exhaust lines in a single manifold. This patent consolidated inlet and exhaust lines in such a single manifold to minimize the space taken up by the device within the engine compartment and utilized marman and flange type couplings. Like earlier single line exhaust gas transfer arrangements, this earlier single manifold system did not minimize creating of turbulence by avoiding sharp bends in the lines. Additionally, where earlier exhaust transfer lines and manifolds have generally employed flange and bolt type couplings or like arrangements that tend to create turbulence at their junctions, the present invention provides telescoping couplings of inlet and exhaust ends and an integral turbine housing, all arranged to minimize creation of turbulence. Further, unique to the present invention, the telescoping coupling of the manifold inlet chamber to a vehicle exhaust line involves a ball segment end coupling of the vehicle exhaust line for fitting into a sleeve or collar end of the manifold inlet chamber. The ball segment provides a seal with the sleeve or collar wall while allowing for some pivotal movement of that vehicle exhaust line.

Unlike earlier manifold systems the double chambered turbine housing and seal of the present invention provides an assembly that will take up a minimum of space as is available within the engine compartment and is easily mounted therein. The system of the present invention presents a first recognition of the value to operational efficiency of transferring exhaust gas with a minimum creation of turbulence and resultant energy loss. The system, to improve efficiency, includes, at an exhaust outlet chamber that is opposite to the turbine chamber, an area of large cross-section wherein the gas flow exhausted from that turbine chamber will immediately experience a large volume increase. The exhaust gas pressure is thereby proportionally lowered to provide a large differential pressure between inlet and outlet sides of that turbine chamber. This pressure differential provides a quick response of turbine system.

SUMMARY OF THE INVENTION

It is, therefore, a principal object of the present invention to provide a double chambered turbine housing where an exhaust inlet chamber thereof is formed to have a constant crosssection without abrupt changes of direction to an entrance to an integral volute, which volute provides a uniform taper around a scroll portion that optimumly reduces the gas flow volume and proportionally increases its pressure while providing a uniform change of direction of the gas flow to a throat of a turbine chamber, the arrangement minimizing the creation of turbulence in that exhaust gas flow so as to retain a maximum energy potential.

Another object of the present invention is to provide an exhaust chamber of the housing that is constructed to have a large volume or area immediately opposite to the turbine chamber exducer bore to maximize a pressure differential between the volute inlet throat and the exducer bore of that turbine chamber so as to provide for a rapid turbine response.

Another object of the present invention is to provide, as a seal between a vehicle exhaust inlet line end and a collar end of the exhaust inlet chamber, a ball segment that is formed around the vehicle exhaust inlet line end to have, essentially, the same diameter as does an inlet chamber collar inner wall, the ball segment end to slide into that collar, sealing to the collar inner wall at a point around the ball segment circumference, which seal allows for some pivotal movement between the exhaust inlet line and inlet chamber without a disruption of the seal integrity.

Still another object of the present invention is to provide a double chambered turbine housing that can be cast as a single unit to take up a minimum of space within an engine compartment.

Still another object of the present invention is to provide a double chambered turbine housing that is simple and economical to construct and can be easily mounted in a vehicle exhaust system.

In accordance with the above objects the present invention is in a double chambered turbine housing and seal that is formed as a single unit and includes both vehicle exhaust inlet and outlet chambers. The housing also includes a turbine chamber that is open to without the housing and to both the inlet and exhaust chambers that is for containing a turbine wheel of an exhaust gas driven turbine air compressor turning therein. The invention provides for attaching the exhaust gas driven turbine air compressor across the opening into the turbine chamber, the compressor turbine wheel in turning arrangement therein.

The housing inlet chamber is constructed to present a uniform cross-section from an open end to an entrance or throat of a scroll volute section thereof with changes in gas flow direction through a dogleg bend thereof accomplished through a gradual curving of the chamber wall. So arranged, the exhaust gas flow through the inlet chamber is redirected with a minimum creation of turbulence. In the inlet chamber scroll volute the flow volume is reduced through the scroll, proportionally raising that flow pressure. Which scroll volute interior wall is formed to have a uniform taper and constant direction change and discharges the flow through a turbine chamber throat. The flow is passed through the turbine chamber throat at approximately a right angle to a plane thereacross, and is directed against the turbine wheel blades.

Exhaust gas that is exhausted or passed from the turbine chamber will travel through an exducer bore of the turbine housing that is adjacent to the turbine wheel bottom, which flow travels into an expansion section of the exhaust chamber. The expansion section is formed to have a significantly greater volume that is present at the inlet opening or throat of the scroll volute. The expansion section thereby provides a rapid volume change in the exhaust gas flow, resulting in a large pressure reduction in that exhaust gas flow. A large pressure differential is thereby created across that turbine chamber. Such pressure differential provides for a quick response in compressor output responsive to changes in the volume of exhaust gas flow produced by changes in engine R.P.M.

As set out above, the inlet chamber end collar is arranged to be telescoped over an open end of an engine exhaust inlet line. The engine exhaust inlet line includes a ball segment that is formed of metal around the end thereof and has essentially the same diameter as does the inlet chamber collar interior wall. The ball segment is to slide into that collar, fitting snugly therein and sealing against the collar wall at a point of contact of the ball segment circumference to that collar wall. This arrangement allows for some pivotal movement between that housing inlet chamber collar wall and the exhaust inlet line without a disruption of the seal.

For completing the mounting of the housing in a vehicle exhaust system the housing exhaust chamber collared end is also arranged to be telescoped over an end of a pipe or line that connects to the vehicle exhaust system. Additionally, a flat surface that is formed around the opening into the housing turbine chamber is arranged to receive and be bolt coupled to the housing of an exhaust gas driven turbine air compressor, allowing a turbine wheel of that compressor to turn freely in that turbine chamber.

THE DRAWINGS

The following drawings illustrate that which is presently regarded as the best mode for carrying out the invention:

Figure 1:
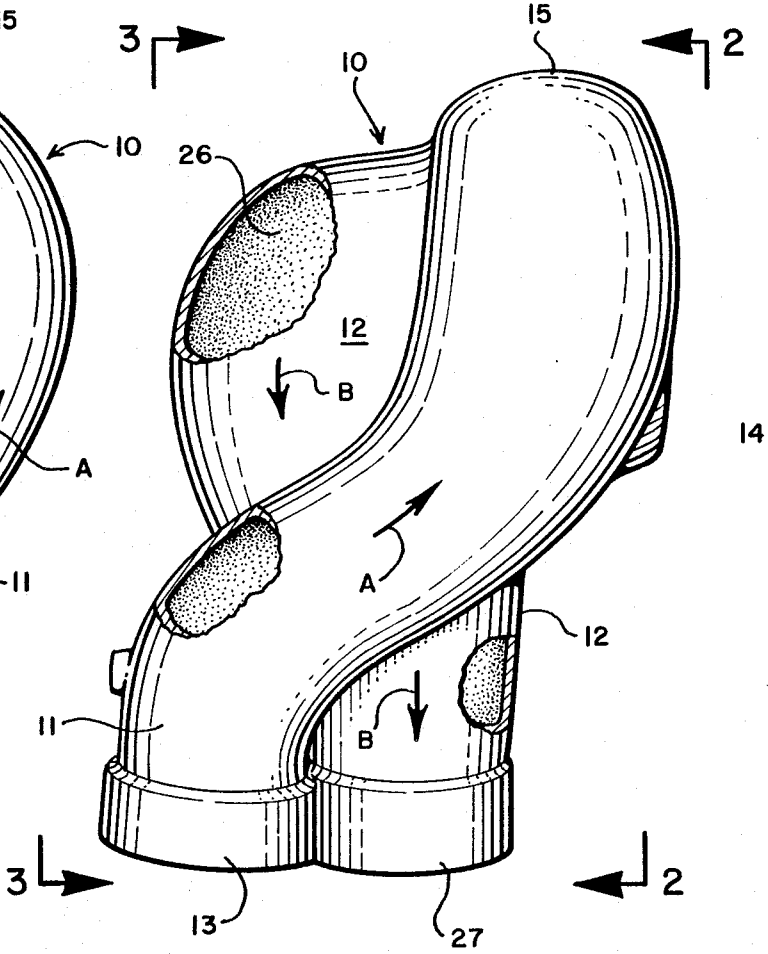
FIG. 1 is a side elevation perspective view of the improved double chambered turbine housing of the present invention.

FIG. 4 shows an exploded perspective side view like that of FIG. 1, except that the double chambered turbine housing is shown as having been rotated so as to expose a mating surface that is formed around an opening into a turbine chamber for receiving a mating ring of an exhaust gas driven turbine air compressor fitted thereon, as shown in broken lines, and showing a segment of the housing removed to expose portions of an inlet chamber volute and the turbine chamber;

FIG. 5 is a fragmentary sectional view showing the exhaust gas driven turbine air compressor mounted to the double chambered turbine housing of the present invention, showing the compressor turbine wheel arranged for turning in the housing turbine chamber and showing with arrows the exhaust gas flow through the turbine chamber throat and out its exducer bore;

FIG. 6 shows a cross-sectional view of segments of the inlet and exhaust chamber ends of the housing telescoped over sections of ends of vehicle exhaust inlet and outlet lines and includes arrows showing the exhaust gas flow therethrough; and FIG. 7 shows an expanded view of the inlet chamber collar end of FIG. 6, with the vehicle exhaust line shown in broken lines, that vehicle exhaust line end including, a ball segment seal fixed therearound, the vehicle exhaust line shown pivoted between limits.

DETAILED DESCRIPTION

FIG. 1 shows a profile perspective view of a double chambered turbine housing 10 of the present invention hereinafter referred to as housing. In FIG. 1 sections of the housing 10 are shown removed for illustrating wall thickness and showing inlet and exhaust chambers 11 and 12, respectively, of the housing as separated independent chambers. FIG. 1 further illustrates, with arrows A and B, the direction of exhaust gas flow through the housing. Shown in FIGS. 1 through 5, arrow A illustrates a vehicle exhaust gas flow through inlet chamber 11, including scroll volute 15, and through an inlet throat 16 into a turbine chamber 17. Arrow B illustrates the direction of exhaust gas flow from an exducer bore 25 of that turbine chamber that passes into and through an expansion section 26 of exhaust chamber 12.

Shown in FIG. 1 the inlet chamber 11 includes a dogleg bend therein whereat the exhaust gas flow direction is translated through ninety (90) degrees so as to enter, at a right angle, a throat 14 of scroll volute 15, hereinafter referred to as volute, shown in broken lines in FIGS. 2, 4 and 5. The inlet chamber 11 cross-section is maintained constant from an inlet chamber end collar 13, hereinafter referred to as collar. Through this portion of the inlet chamber 11 the chamber cross-section is maintained as constant with the chamber walls sloped uniformly through the dogleg, avoiding abrupt direction changes, so as to provide a smooth directional change in that exhaust gas flow to the volute 15. Turbulence in the gas flow is thereby minimized, also minimizing energy losses in that flow. From the volute throat 14 to a throat 16 of turbine chamber 17, volute 15 provides a uniform cross-section reduction through nearly a full circle. Within volute 15 the gas flow direction is changed so as to enter the turbine chamber 17 at approximately a right angle thereto. The entering gas flow strikes blades **18*a* of a turbine wheel 18, as shown in broken lines in FIGS. 4 and 5, which is journaled to turn in turbine chamber 17. In the volute 15 the gas flow volume is uniformly decreased through the scroll, proportionally increasing the gas pressure while uniformly changing flow direction with a minimum creation of turbulence. So arranged, the exhaust gas flow entering turbine chamber 17 will have incurred minimum energy losses in its passage through the inlet chamber 11 of manifold 10**.

As set out above, the housing 10 inlet chamber 11 from collar 13 is formed to have a uniform cross-section with smooth gradual direction changes through a dogleg bend that provides an off-set of ninety (90) degrees. Also, as set out above, the cross-sectional area of the inlet chamber will be essentially the same from the inlet collar 13 to a throat 14 of volute 15, and the interior wall of volute 15 is smooth and maintains a constant arc through the scroll, to the entrance or throat 16 of the turbine chamber 17. Accordingly, in practice, it has been found with the smooth wall and gradually angled and tapered construction of inlet chamber 11, the energy available in an exhaust gas flow will be preserved to be nearly the same as the energy available at the end of an exhaust inlet line 28 that extends from a vehicle exhaust manifold, not shown. Additionally, to further provide for a minimum turbulence in the exhaust gas flow, a telescoped coupling and seal of manifold inlet collar 13 over the vehicle exhaust line 28 is provided. In this telescoped arrangement, as will be set out hereinbelow with respect to a discussion of a unique ball segment 31 seal of the present invention, the inner walls of the collar 13 and vehicle exhaust line 28 will be in essentially abutting relationship.

Figure 2:
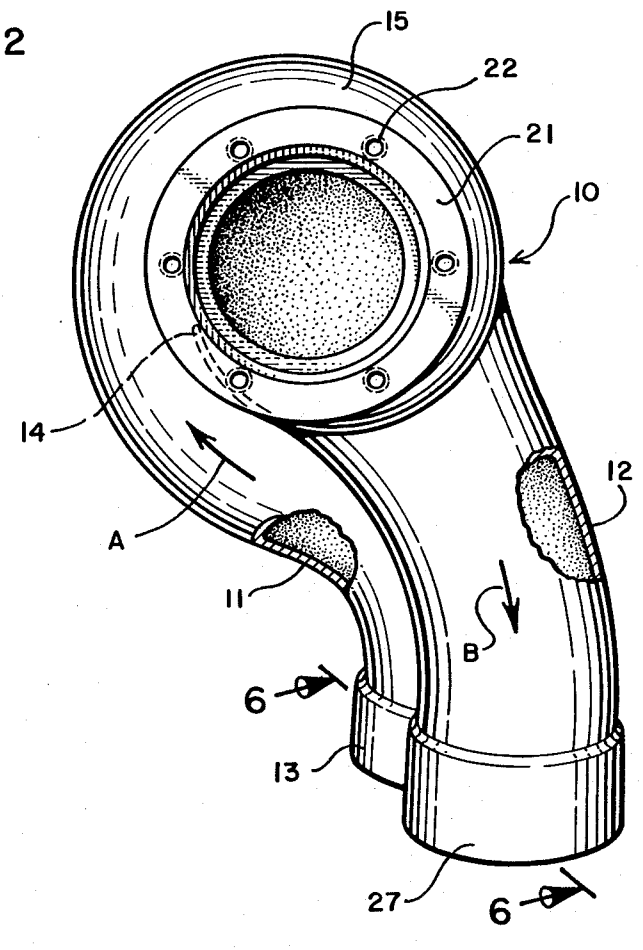
FIG. 2 shows a frontal perspective view of the double chambered turbine housing of FIG. 1.
Figure 3:
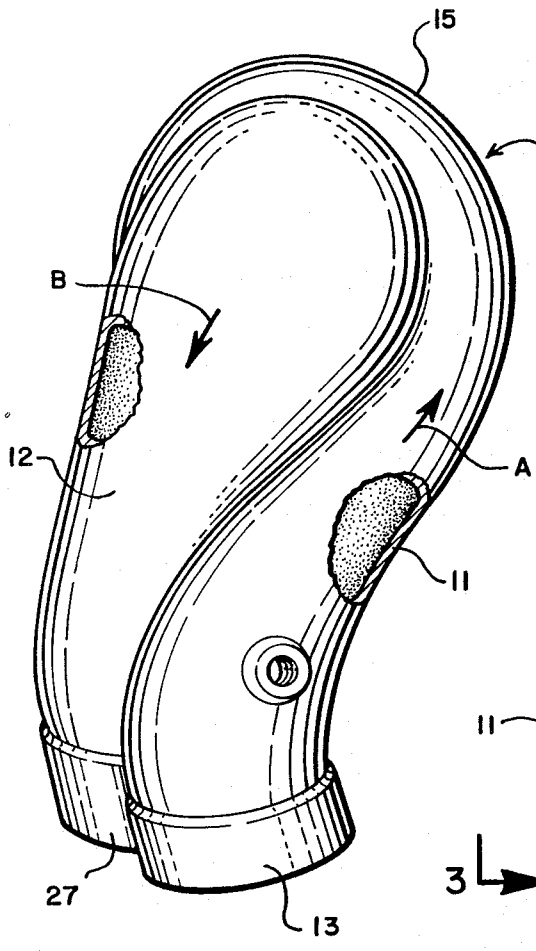
FIG. 3 shows a rear perspective view of the double chambered turbine housing of FIGS. 1 and 2, showing in broken lines the interior walls of inlet and exhaust chambers thereof.

FIG. 3, provides a rear view of the housing 10 of FIGS. 1 and 2, and is included to also show the uniform gradual bends that are formed therein.

Heretofore, manifolds, housings and exhaust gas lines for passing vehicle exhaust gas into a turbine housing have generally involved flange type couplings and the like, with little regard or attention paid to the creation of turbulence in a gas flow therethrough as occurs at such junction. The present invention, as set out above, to minimize turbulence provides for both gradual gas flow direction changes through an inlet chamber and for a telescoping coupling and seal arrangement of inlet collar 13 with vehicle exhaust line 28, minimizing turbulence and thereby maintaining the exhaust gas energy at its peak. Shown best in FIGS. 4 and 5, the housing 10, in addition to the inlet and exhaust chambers 11 and 12, respectiely, also includes the turbine chamber 17 wherein the turbine wheel 18, shown in broken lines in FIGS. 4 and 5, is journaled to turn. The turbine wheel 18 is part of an exhaust gas driven turbine air compressor 19, shown in broken lines and hereinafter referred to as compressor. Shown in FIG. 5, compressor 19 includes the turbine wheel 18 that is arranged to turn in the turbine chamber 17 under the urgings of the exhaust gas flow therethrough. For mounting the compressor 19 to housing 10, a mating ring clamp 20 is provided that fits over a lip **19*a* that is formed around the compressor 19 housing, which mating ring clamp will fit, in flush engagement onto a flat surface 21, that is formed around an opening into the housing turbine chamber 17. The mating ring clamp 20 includes spaced holes 20*a* formed therethrough that are for alignment with like spaced apart threaded holes 22 that are formed in housing flat surface 21. So arranged, the compressor 19 is mounted to the housing 10, as shown in FIG. 5, by fitting bolts 24, or like connectors, through holes 20*a*, and turning them into threaded holes 22**.

The turbine wheel 18 is journaled, in close fitting engagement, to turn within the turbine chamber 17. Shown in FIG. 5, exhaust gas enters the turbine chamber through throat 16, which gas flow has been reduced in volume, with its pressure proportionally raised appropriate to operate the particular compressor 19 selected for a specific vehicle engine application. Accordingly, the exhaust gas pressure in turbine chamber 17 will be that which is optimum for the particular engine, as determined by the configuration of volute 15. The exhaust gas flow passed into the turbine chamber 17 acts against the fins or blades **18*a* of turbine wheel 18 to turn that turbine wheel at an RPM suitable to produce an optimum compressor 19 output. After turning turbine blades 18*a*, the flow is exhausted through an exducer bore 25 of the turbine chamber aligned with the axis of rotation of the turbine wheel 18, that flow traveling into the expansion section 26 of exhaust chamber 12. After travel through the exhaust chamber 12, the flow passes out from a collar end 27 of that chamber and is exhausted through an exhaust line 30, shown in broken lines in FIG. 6. The exhaust line 30 is preferably telescoped into exhaust chamber collar end 27** and is maintained therein by friction as a loose fit, or may include a coupling, such as a clamp, not shown.

Additional to the smooth, free, transition of that exhaust gas flow through the dogleg in inlet chamber 11, and around the volute 15, a telescoped coupling of exhaust gas line 28 to collar 13 is provided whereby the interior walls of that exhaust inlet line 28 and inlet chamber collar 13 will essentially align in abutting relationship providing a smooth unobstructed passage to the flow across the junction, minimizing turbulence. This coupling, as shown best in FIGS. 6 and 7, includes a smooth internal wall 29 of collar 13 that is stepped inwardly to a second cylindrical wall that the vehicle exhaust line inner wall abut against. The wall 29 to receive a ball segment 31 that is formed around the cylindrical exhaust line proximate to its open end to closely fit therein. The ball segment 31 is formed of metal and is preferably machined or otherwise formed around that vehicle exhaust line 28 end. Exhaust line 28 is open therethrough and connects at its opposite end, not shown, to a vehicle exhaust manifold, and is to directly transfer exhaust gases from that manifold to the inlet chamber 11.

As shown best in FIG. 7, the ball segment 31 diameter is selected to duplicate the collar 13 inside wall 29 circumference. Preferably, to accommodate the wide temperature range this coupling will be subjected to, the ball segment 31 and exhaust inlet line should be formed of the same metal and the inlet chamber 13 should either be formed of the same metal or a metal having a like coefficient of expansion. The coupling will thereby expand and contract at the same rate without breaking a seal therebetween. So arranged, the ball segment 31 circumference will be approximately equal to and will fit snugly against the collar 13 inside wall 29. Thereby, the point of sealing engagement of that ball segment 31 to collar wall 29 will be a single point of contact extending around that ball segment circumference. This point of contact around the ball segment circumference can change the ball segment surface rolling on the collar inside wall 29 as the vehicle exhaust line is pivoted, as shown in FIG. 7. In such pivoting, so long as a point around the ball segment 31 circumference remains in contact with the collar wall 29, a sealing engagement of the ball segment with that collar wall is maintained. Accordingly, the exhaust gas inlet line 28 pivoting is limited by the width of the ball segment. In practice, in a preferred embodiment, for a ball segment of one half (½) inch in width and a diameter of two and nine sixteenths (2 9/16) inches, and an exhaust inlet line of one (1) foot in length, that exhaust inlet line can be pivoted up to four (4) inches of arc at its end opposite to the ball segment end. Which is approximately fifteen (15) degrees of arc without a disruption to the seal between the ball segment circumference and the collar interior wall 29. The arc of travel distance is further limited by the length of collar wall 29. So arranged, telescoping of the ball sement 31 onto the collar 13 provides a secure metal to metal seal at a point around the ball segment circumference that engages the collar wall 29. The contact area of this seal is, of course, very narrow and facilitates the housing 10 being easily removed or installed by manually pulling or pushing the housing off from or onto the exhaust inlet line 28, requiring only a minimum of effort on the part of an operator.

The volute 15, as set out above, is formed to provide an exhaust gas volume reduction to a desired pressure so as to optimumly turn the turbine wheel 18 at a rate to compress a fresh air input flow, broken arrow C, to a required compressed air output flow, shown as a broken arrow D, in FIG. 4. This compressed air flow is to be at a pressure to match the efficiency for the particular selected exhaust gas driven turbine air compressor 19 to conform to an efficiency island thereof. Each such efficiency island is one of the compressor optimum compression points for the particular exhaust gas driven turbine compressor. Different exhaust gas driven turbine compressors have different efficiency islands and accordingly, it should be understood, the volute 15 of the present invention is designed for the particular compressor it is intended for use with. The compressed air produced by operation of the selected exhaust gas driven turbine air compressor is, of course, for mixing with fuel, with that mixture then injected for burning in an internal combustion engine.

As set out above, the exhaust gas flow passed from the turbine housing 17 travels through exducer bore 25 and into expansion section 26 of the exhaust chamber 12. Shown best in FIG. 5, the expansion chamber 26 provides a significantly greater cross-sectional area as compared to the cross-sectional area of the throat 14 of volute 15. In the preferred embodiment the expansion section 26 is approximately four (4) times greater in cross-section as compared to the volute inlet throat 14. This provides a large increase in volume to the exhaust gas passed from the turbine chamber when it enters the exhaust chamber with a proportional reduction in pressure. A large pressure deferential is thereby created between the volute inlet or throat 14 to the exhaust chamber expansion section 26. This pressure differential, in practice, provides a minimum pressure resistance to an increase in turbine wheel R.P.M. or spin up with an exhaust gas flow pressure increase.

In practice therefore, the housing 10 can easily be installed, by attaching it to the compressor 19, as set out above, with a telescoping of the housing inlet and exhaust collars 13 and 27, respectively, over the exhaust inlet line 28, and vehicle exhaust line 30, respectively. Which housing inlet and exhaust collars 13 and 27 are each stepped inwardly to provide surfaces whereagainst exhaust inlet and vehicle exhaust line ends each abut. Accordingly, the housing 10 can be easily removed by turning connectors 24 out of threaded holes 22 in the flat housing surface 21 formed around the opening into the turbine chamber and pulling the inlet and exhaust chamber collars 13 and 27 out of their telescoped engagement with exhaust inlet and vehicle exhaust lines 28 and 30, respectively.

As set out the inclusion of separate inlet and exhaust chambers and the turbine chamber into one housing provides a significant space savings within the vehicle engine compartment as compared to earlier separate arrangements and further provides a capability for easily installing that housing 10.

Hereinabove has been set out a description of a preferred embodiment of the double chambered turbine housing of the present invention and ball segment seal for mounting that housing 10 in a vehicle exhaust system. From the above discussion it should be obvious that the housing 10 can be configured with a volute 15 that is specially configured to provide an optimum exhaust gas pressure for a particular exhaust gas driven turbine air compressor so as to derive a maximum efficiency therefrom. Further, it should be understood, the present invention is not in the particular configuration of integral inlet and exhaust chambers 11 and 12 with a scroll volute. Rather, the invention is in a housing 10 incorporating in a single housing inlet, turbine and exhaust chambers, including an inlet chamber with smooth interior walls that changes direction uniformly and gradually to re-direct an exhaust gas flow into a throat of a scroll volute portion thereof, so as to create only minimum turbulence within an exhaust gas flow thereby maintaining the energy available in that flow to optimumly turn a turbine wheel of a selected exhaust gas driven turbine air compressor. Accordingly, while preferred embodiments of housing 10 and ball segment seal 31 have been shown and described herein, it should be understood that the present invention can be varied within the scope of this disclosure without departing from the subject matter coming within the scope of the following claims, which claims I regard as my invention.

I claim:

1. A double chambered turbine housing comprising, in a single cast housing, independent inlet and exhaust chambers, said inlet chamber for passing vehicle exhaust to a turbine chamber, with vehicle exhaust passed from said turbine chamber traveling through said exhaust chamber into said vehicle exhaust system, said inlet chamber having a first open end for coupling to an exhaust inlet line from a vehicle exhaust manifold for passing exhaust gas therethrough and includes seal means at said first open end for prohibiting exhaust gas leakage at said coupling, said inlet chamber from said first open end, having smooth interior walls that are angled uniformly through a dogleg bend across the exhaust chamber and has a uniform cross-section to an open throat of a scroll volute portion of said inlet chamber, which scroll volute has smooth interior walls that taper uniformly around the scroll to an inlet throat of said turbine chamber, which turbine chamber is formed between said inlet and exhaust chambers and is open across one face to receive a turbine wheel of a conventional exhaust gas driven turbine air compressor journaled to turn therein, said housing opening into said turbine chamber is arranged for mounting said exhaust gas driven turbine air compressor thereto, which said turbine chamber opens through an exducer bore into a first expansion section end of said exhaust chamber, the other or second exhaust end of which exhaust chamber is arranged for connection to an exhaust line of a vehicle exhaust system, and said first open end of said inlet chamber and said exhaust end of said exhaust chamber are alongside one another; means for mounting said exhaust gas driven turbine air compressor to said housing; and means for coupling said second exhaust end of which exhaust chamber to said vehicle exhaust line.

2. A double chambered turbine housing as recited in claim 1, wherein the inlet chamber first open end includes a collar having a first smooth cylindrical inner wall; and the seal means consists of an arcuate ball segment that is formed around the end of the exhaust inlet line from the vehicle exhaust manifold, which said arcuate ball segment has diameter that is approximately the same as the diameter of said collar first cylindrical smooth inner wall.

3. A double chambered turbine housing as recited in claim 2, wherein the arcuate segment and collar are each formed of metal to have like coefficients of expansion to maintain sealing engagement at a point of contact around said arcuate ball segment circumference with the collar first smooth cylindrical inner wall at all temperatures as will exist at this coupling.

4. A double chambered turbine housing as recited in claim 2, wherein the collar is stepped inwardly from the first smooth cylindrical inner wall to a thickness to form an abutting surface that will align the inner wall of the exhaust inlet line.

5. A seal as recited in claim 2, wherein the arcuate ball segment has a width of approximately one half (½) an inch and a diameter of approximately two and nine sixteenths (2 9/16) inches.

6. A quick coupling arrangement as recited in claim 5, wherein the inlet chamber collar second cylindrical inner wall surface will essentially align with the inner wall of the vehicle exhaust inlet line telescoped in said inlet chamber collar.

7. A double chambered turbine housing as recited in claim 1, wherein the scroll volute portion of the inlet chamber tapers uniformly inwardly at a constant arc, reducing in cross-section along smooth walls to the turbine chamber throat, which volute cross-section reduction from the inlet throat of said scroll volute to said turbine chamber throat is selected or a particular exhaust gas driven turbine air compressor.

8. A double chambered turbine housing as recited in claim 1, wherein the opening through the housing into the turbine chamber is circular and the surface therearound is machined flat to accommodate a mating ring clamp of an exhaust gas driven turbine air compressor, which mating ring clamp includes spaced apart holes formed therethrough that align with threaded holes formed at intervals in said machined flat surface; and further including bolt means each for fitting through a mating ring clamp opening and turning in one of said threaded holes as the means for mounting said exhaust gas driven turbine air compressor to said housing.

9. A double chambered turbine housing as recited in claim 1, wherein the expansion section end of the exhaust chamber is formed to have greater cross-sectional area than the cross-sectional area of the inlet throat of the scroll volute, providing thereby a pressure differential across the scroll volute and turbine chamber with said exhaust section of said exhaust chamber.

10. A double chambered turbine housing as recited in claim 9, wherein the cross-sectional area at the exhaust chamber expansion section is approximately four times greater than the cross-sectional area at the inlet side of the scroll volute.

11. A double chambered turbine housing as recited in claim 1, wherein the exhaust chamber includes a collar at its other or second exhaust end for telescoping over the end of a vehicle exhaust line, as the means for coupling said second exhaust end of said exhaust chamber end to said vehicle exhaust line.

12. A quick coupling arrangement for mounting a double chambered turbine housing comprising, in a single cast housing, separate inlet and exhaust chambers with a turbine chamber therebetween, which turbine chamber is open to receive a conventional exhaust gas driven turbine air compressor journaled therein and includes to said housing open inlet and exhaust ends of said inlet and exhaust chambers each end including a collar, which collars are in side by side configuration, each for telescoping over an end, respectively, of an exhaust inlet line that extends longitudinally from a vehicle exhaust manifold, and an exhaust outlet line that connects into a vehicle exhaust system, said collar end of said inlet chamber further including a first smooth cylindrical inner wall that extends longitudinally from the collar open end, and is stepped inwardly to a second cylindrical inner wall of lesser diameter, said first smooth cylindrical inner wall of telescope over said vehicle exhaust inlet line end, which vehicle exhaust inlet line end includes seal means for contacting, in sealing engagement, said collar first cylindrical inner wall, and said collar end of said manifold exhaust chamber also has an inner cylindrical wall that is arranged for telescoping, in close fitting engagement, over an end of said vehicle exhaust outlet line.

13. A quick coupling arrangement as recited in claim 12, wherein the seal means between the inlet chamber collar and the vehicle exhaust inlet line is an arcuate ball segment that is formed around the end of the vehicle exhaust inlet line, which said arcuate ball segment has a diameter that is approximately the same as the diameter of the inlet chamber collar first cylindrical wall.

14. A quick coupling arrangement as recited in claim 13, wherein the arcuate ball segment has a width of approximately one half (½) an inch and a diameter of approximately two and nine sixteenths (2 9/16) inches.

15. A quick coupling arrangement as recited in claim 13, wherein the arcuate ball segment and inlet chamber collar are each formed of metal to have like coefficients of expansion for maintaining sealing engagement around said arcuate ball segment circumference point of contact of said inlet chamber collar first cylindrical inner wall at all temperatures as will exist at this coupling.

16. A quick coupling arrangement as recited in claim 12, wherein the means for mounting the exhaust gas driven turbine air compressor to the housing consists of a mating ring means for arrangement with the exhaust gas driven turbine air compressor, said mating ring means to slide over a body of said exhaust gas driven air compressor to engage a lip formed around the exhaust gas driven turbine air compressor body, adjacent to turbine blades thereof, said mating ring means to fit against the flat surface around the housing opening into the turbine chamber, which mating ring means includes holes formed at intervals therethrough to align with tapped holes formed at like intervals into said flat surface around said housing opening into said turbine chamber; and connector means for fitting through said mating ring means holes and turning into said tapped holes.

* * * * *